US007737858B2

(12) United States Patent
Matityaho

(10) Patent No.: US 7,737,858 B2
(45) Date of Patent: Jun. 15, 2010

(54) SYSTEM, METHOD AND KIT FOR MANAGING INVENTORY

(75) Inventor: Shlomo Matityaho, Tel Mond (IL)

(73) Assignee: Logitag Systems Ltd., Netanya (IL)

( * ) Notice: Subject to any disclaimer, the term of this patent is extended or adjusted under 35 U.S.C. 154(b) by 341 days.

(21) Appl. No.: 11/723,664

(22) Filed: Mar. 21, 2007

(65) Prior Publication Data

US 2008/0231456 A1 Sep. 25, 2008

(51) Int. Cl.
*G08B 13/14* (2006.01)

(52) U.S. Cl. ..... 340/572.8; 340/572.7

(58) Field of Classification Search ..... 340/572.8, 340/572.7; 235/385; 705/22, 28
See application file for complete search history.

(56) References Cited

U.S. PATENT DOCUMENTS

| | | | | |
|---|---|---|---|---|
| 5,334,882 | A | 8/1994 | Ting | |
| 5,434,775 | A | 7/1995 | Sims et al. | |
| 5,528,232 | A | 6/1996 | Verma et al. | |
| 6,445,297 | B1 * | 9/2002 | Nicholson | 340/572.7 |
| 6,935,560 | B2 | 8/2005 | Andreasson et al. | |
| 2002/0091594 | A1 | 7/2002 | Rosenberg et al. | |
| 2002/0183882 | A1 | 12/2002 | Dearing et al. | |
| 2003/0088442 | A1 | 5/2003 | Michael et al. | |
| 2003/0216969 | A1 | 11/2003 | Bauer et al. | |
| 2005/0091128 | A1 | 4/2005 | Luo et al. | |
| 2006/0054692 | A1 | 3/2006 | Dickey | |

FOREIGN PATENT DOCUMENTS

| | | | |
|---|---|---|---|
| DE | 29912346 | U1 | 12/1999 |
| DE | 10060156 | A1 | 6/2002 |
| DE | 20211177 | U1 | 12/2004 |
| WO | WO 01/57762 | A1 | 8/2001 |
| WO | WO 02/35394 | A1 | 5/2002 |
| WO | WO 03/025704 | A2 | 3/2003 |

OTHER PUBLICATIONS

IPER and Written opinion from PCT/IL2008/000404.

* cited by examiner

*Primary Examiner*—John A Tweel, Jr.
(74) *Attorney, Agent, or Firm*—Browdy and Neimark, PLLC

(57) ABSTRACT

A system, method and kit for managing RFID-tagged articles. The kit allows transforming a cabinet to an RFID-enabled cabinet. The transformation can be performed in the field. The RFID-enabled cabinet is fitted with a controller, communication means, one or more RFID readers, one or more antennae for reading RFID tags, and a multiplexer connecting the RFID reader and the antennae. Each antenna comprises a switch for activating and deactivating the antenna and a tuning board. No more than one antenna is activated at a given time thus avoiding interference between the different antennae. A central database can communicate with the RFID-enabled cabinets thus managing an inventory of RFID-enabled articles across multiple cabinets in multiple geographies.

17 Claims, 7 Drawing Sheets

SYSTEM, METHOD AND KIT FOR MANAGING INVENTORY

FIELD OF THE INVENTION

The present invention relates to a system, method and kit for managing inventory, and in particular to transforming existing, installed cabinets to RFID-enabled cabinets.

BACKGROUND OF THE INVENTION

Managing inventories of Radio Frequency Identification (RFID) tagged articles is a common practice in the industry. Numerous commercial applications exist for managing RFID-tagged inventories either in a warehouse type location or in a specific storage cabinet. Typically, the RFID tags are read by an RFID reader when articles enter or exit the warehouse or cabinet, or the warehouse or cabinet are sampled at certain time points in order to determine the inventory levels or specific conditions of the tagged-articles. For example, an RFID tag may contain information about the expiration date of the article, so it could be interesting to read all RFID tags in order to determine the expected shelf life of each article.

One of the main problems that companies marketing high-value items such as medical devices, pharmaceuticals and perfumes, need to overcome is the ability to control different pricing schemes in different geographical regions. Sometimes the difference in prices of the same item in different geographical locations can be very significant. Accordingly, one of the manufacturer's main concerns is to block the possibility of a product destined to be sold in a low price market finding its way to a high price market.

RFID-based inventory systems are common in the industry and a variety of implementations are known. Key-Trac's U.S. Pat. Nos. 6,707,381 and 6,407,665 disclose a container that registers access and exit of objects using a coupled computer outside or inside the container. Key-Trac's container does not include integrated processing capabilities.

American Greetings Corporation's U.S. Pat. No. 6,927,692 establishes a system for real-time management of an inventory with RFID tags using a computing component to manage inventory quantities. It does not provide time-based reports regarding the status of the inventory.

Safety Syringes' U.S. Pat. No. 6,935,560 establishes a medication dispensing unit coupled with a processor unit that registers entry and exit of medications, and issues alerts if inventory quantities fall below a certain threshold.

Techtalion Limited U.S. Pat. No. 6,650,240 discloses a briefcase with articles, wherein the presence of articles inside the briefcase is detected when desired. Alerts are issued if an article is missing. U.S. Pat. No. 6,650,240 only checks the presence or absence of objects when requested, and does not register events in real-time.

In situations where articles without RFID tags are stored in a non-RFID enabled cabinet, it may be easy to fit articles with RFID tags, but a regular cabinet cannot be fitted with efficient RFID reading means in the field. Rather, cabinets adapted to storing RFID-tagged articles are custom made and as such are priced accordingly.

Building a cabinet for storing RFID-tagged articles presents certain challenges to the manufacturer. Some of these challenges include: creating a full RF coverage of the storage areas of the cabinet; having the ability to locate inventory up to shelf level, even when the shelves are very closely located; overcome major RF issues mainly adapting RF antennas in an area where many antennas are on the same surface (fields of planar antennas on the same surface); overcome the influence of the physical location of the cabinet RFID performance; and having full flexibility on easily building any size of antenna needed at the cabinet.

As a result, the antenna or antennae in the cabinet need to be positioned in very specific places in the cabinet in order maximize the coverage of the storage area of the cabinet and minimize interference between the different antennae.

It would be desirable to be able to use existing cabinets and transform them in the field to RFID-enabled cabinets. It would also be desirable to enable the transformed cabinets to read RFID-tagged articles in multiple formats and protocols.

Organizations, such as hospitals, buying large quantities of disposable or renewable articles from different suppliers and manufacturers need to track diligently the inventory levels of these articles in order to replace on time articles that were either consumed or that their shelf life has ended.

On the other hand, suppliers of such disposable or renewable articles do not have a clear idea, and frequently have no idea, how their products are used within a customer organization. It would be highly valuable, for example, for a supplier to know that a given article is depleted or near depletion in one department since the supplier could ship necessary quantities of that article on time to that department.

Hospitals usually buy their medical devices from several suppliers or vendors and lately many hospitals are trying to move to a consignment procurement method. The new inventory methods oblige the hospital to provide suppliers and vendors with easy access to its current inventory level including inventory inside surgery rooms. This creates a great need of remote and seamlessly inventory control. This emerging need is greatly felt especially in the healthcare, telecommunications, and military industries.

SUMMARY OF THE INVENTION

It is an object of the present invention to transform an existing cabinet to an RFID-enabled cabinet adapted for storing RFID-tagged articles and for communicating inventory status to a central database. Such cabinet transformation can be done in the field and can be adapted according to the characteristics and layout of each cabinet.

The present invention thus relates to a method for transforming a cabinet for storing RFID-tagged articles to an RFID-enabled cabinet, the method comprising the steps of:

(i) installing one or more RFID readers;

(ii) installing a controller;

(iii) adding communication means to the cabinet;

(iv) installing one or more antennae adapted to reading RFID tags of the RFID-tagged articles such that the one or more antennae cover the entire storage area of the cabinet, and each antenna of the one or more antennae comprises a switch and a tuning board, the switch adapted to activating or deactivating the antenna; and (v) activating each antenna of the one or more antennae periodically and reading nearby RFID tags, such that when one antenna is activated all the other antennae are deactivated.

Each RFID reader and controller can be individually installed either inside the cabinet or outside the cabinet, depending on the type of installation desired. If an RFID reader or a controller are installed outside the cabinet, they are typically located nearby the cabinet, for example, up to 30 meters.

In another aspect, the invention also relates to a kit for transforming a cabinet to an RFID-enabled cabinet adapted for storing RFID-tagged articles, the kit comprising:

(i) a controller comprising communication means;

(ii) one or more RFID readers connected to the controller;

(iii) one or more antennae adapted to reading RFID tags of the RFID-tagged articles stored in the cabinet, such that the one or more antennae cover the entire storage area of the cabinet, and each antenna of the one or more antennae comprises a switch and a tuning board, the switch adapted to activating or deactivating the antenna; and (iv) at least one multiplexer connected to the one or more RFID readers and to the one or more antennae such that the at least one multiplexer can communicate, activate and deactivate each antenna individually.

It is another object of the present invention to provide a system for managing inventory of RFID-tagged articles from a plurality of supplier/vendors across one or more geographical locations. For example, a medical product supplier can thus manage inventory levels of his products across multiple hospitals, each hospital have one or more RFID-enabled cabinets of the invention.

In a further aspect, the invention thus further relates to a system for managing inventory of RFID-tagged articles from a plurality of suppliers/vendors, the inventory being distributed across one or more geographical locations wherein each geographical location comprises one or more RFID-enabled cabinets, the system comprising:

(i) a central database system; and (ii) a plurality of RFID-enabled cabinets for storing the RFID-tagged articles, the plurality of RFID-enabled cabinets being connected to the central database, wherein each cabinet comprises: (a) a controller; (b) one or more RFID readers connected to the controller; (c) one or more antennae adapted to reading RFID tags of the RFID-tagged articles such that the one or more antennae cover the entire storage area of the cabinet, and each antenna of the one or more antennae comprises a switch and a tuning board, the switch adapted to activating or deactivating the antenna; and (d) at least one multiplexer connected to the one or more RFID readers and to the one or more antennae such that the at least one multiplexer can communicate, activate and deactivate each antenna individually.

The invention is particularly suited for applications in the healthcare and aerospace industries where high-value, critical or disposable items need to be tracked diligently, though it can easily be used in other commercial applications as well.

DETAILED DESCRIPTION OF THE INVENTION

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention provides a method, a system, and a kit for implementing the method for converting an existing, "normal" cabinet to a cabinet that is RFID-enabled. The cabinet is fitted with a controller, one or more RFID readers, an optional multiplexer (MUX) and communication means. The converted cabinet is characterized by the ability to recognize when an RFID-tagged article is either entered or taken out. The converted cabinet is further characterized by the ability to determine which RFID-tagged articles are stored inside the cabinet at a given moment.

Figure 1:
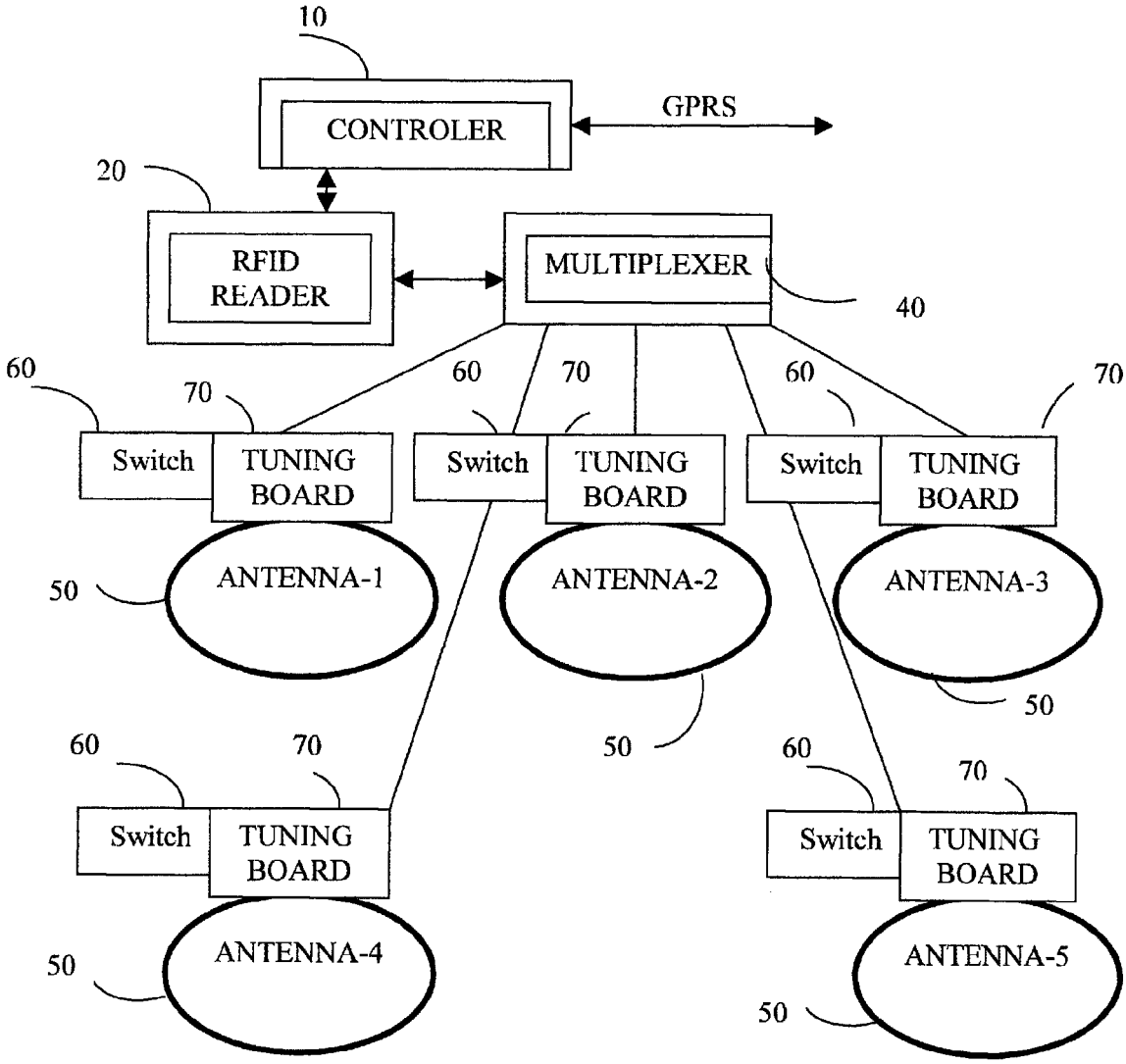
FIG. 1 is a block diagram of a kit according to the invention for transforming a cabinet to an RFID-enabled cabinet adapted for storing RFID-tagged articles.

FIG. 1 illustrates a block diagram of a kit according to the invention for transforming a cabinet to an RFID-enabled cabinet adapted for storing RFID-tagged articles. The controller 10 is connected to one or more RFID readers 20. The RFID readers 20 connected to the controller 10 may be in the same cabinet, or located on separate cabinets located in the vicinity of each other. The RFID reader 20 or readers used can be configured to read RFID tags in multiple protocols and standards.

The controller 10 is fitted with communication means for example General Packet Radio Service (GPRS). Alternatively, the controller 10 may be fitted with any wired or wireless communication means available in the industry such as WiFi, Bluetooth, Short Message Service (SMS), Universal Mobile Telecommunications System (UMTS), a wired or wireless local network connection, or an Internet Protocol (IP) connection.

The RFID reader 20 is connected to one or more multiplexers 40. Each multiplexer 40 supports a predefined number of channels, thus when more channels are needed, it is necessary to connect additional multiplexers 40, for example, in a serial way or any other way practiced in the art.

When planning an RFID-based storage location, the placement and size of each antenna 50 is very important in order to maximize the coverage area for reading RFID-based tags and also in order to minimize interference between the different antennae 50. The antenna 50 of the invention is characterized by the ability to activate or deactivate itself. When an antenna 50 is deactivated, it does not generate any electric activity, and acts like any piece of metal. Each antenna 50 comprises a switch 60 to activate or deactivate the antenna 50, and a tuning board 70. Thus according to the invention, it is possible to construct a field of antennae, all within a close distance of each other (even a few centimeters), wherein no more than one antenna is tuned at any given time. By tuning only one antenna at a time, it is assured that the other nearby antennae (that are not tuned) do not cause any interference to the tuned antenna as would normally be the case if the nearby antennae would be tuned. The RFID antennae used by the invention can be any RFID antenna for example an HF RFID antenna or a LF RFID antenna. HF antennae are more common in the industry and cost less than an LF antenna. LF antennae are used, for example, in a liquid or metallic environment where they yield better performance than HF antennae.

According to the invention, the controller 10, periodically, or when instructed, sends out an instruction to the RFID reader 20 to read or sample the contents of the cabinet. In order to avoid interference from multiple, near-by, active antennae 50, the controller 10 only activates one antenna 50 at a time. The RFID reader 20 reads the captured information received by said antenna 50 (contents of RFID tags read), and said active antenna 50 is deactivated, and another antenna 50 is activated and its captured information is then read by the RFID reader 20. The cycle continues until all antennae 50 were activated and their captured information read by the RFID reader 20. By activating only one antenna 50 at a time, the system assures that the different antennae 50 do not interfere with each other.

Table 1 lists the characteristics of an embodiment of the components of an RFID-enabled cabinet according to the invention.

TABLE 1

| System Reader and Multiplexer (MUX) | |
|---|---|
| Operating Frequency | 13.56 MHz ± 7 kH (for inventory control) |
| Supported Transponders | Tag-it HF, Tag-it HF-I, ISO 15693 compliant transponders |
| Operating Temperature | −20° C. to +65° C. |
| Storage Temperature | −40° C. to +85° C. |
| Max Number of Antennae | 64 units |
| **The Controller and communication** | |
| Communication | TCP/IP and/or RS232/485; GPRS, bridge to WiFi |
| Serial ports Inputs | 2 RS 232 Serial Ports (RJ-45) with +5 V supply for external readers<br>2 RS 232 Serial Ports (9 pins) with +5 V supply for external readers<br>1 RS 485 Serial Ports (RJ-45) with +5 V supply for external readers |
| Sensor Inputs | 4 Sensors input |
| Outputs | 8 Dry contact relays; 2 Power out 5 V; 2 Power out 12 V |
| Operating system | Linux |
| Memory | Flash memory - 32 Kbytes; Working memory - 16 Kbytes |

| DC Electrical Parameters for the system | Min | Max | Units |
|---|---|---|---|
| Supply Voltage | 12 | 24 | Volts |
| Power Consumption | | 60 W | Watts |

Figure 2:
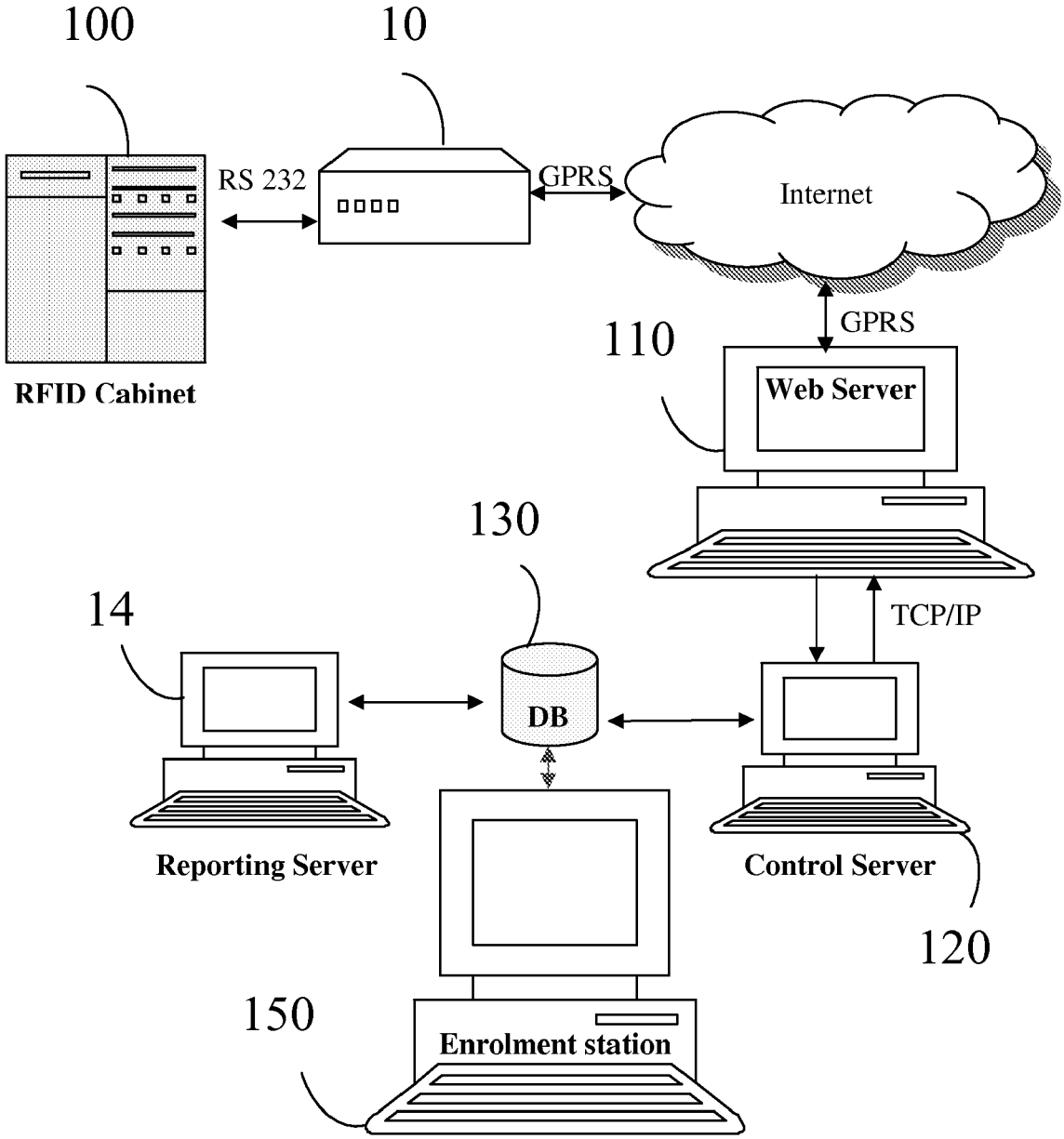
FIG. 2 illustrates an embodiment of a system for managing inventory according to the invention.

FIG. 2 illustrates one preferred embodiment of the present invention, wherein the RFID-enabled cabinet 100 is connected to a central database. The term "central database" as used herein refers to a control server 120 coupled to a database 130. The connection from the cabinet 100 to the central database can be a wired or wireless connection. A wired connection can be via a telephone line, local area network, or wide area network. A wireless connection can be via the cellular network using available technologies such as GPRS, UMTS, Cellular Digital Packet Data (CDPD), 3$^{rd}$ Generation Networks (3G), 4th Generation Networks (4G), SMS, Enhanced Message Service (EMS), or Multimedia Message Service (MMS). Alternatively, a wireless connection can also use Wireless Fidelity (WiFi), Bluetooth, infrared communication or any other wired or wireless technology available in the art.

The central database can be optionally connected to a dedicated reporting server 14, using data mining and statistical reporting applications known in the industry such as Statistical Package for the Social Sciences (SPSS) applications provided by SPSS Inc., 233 S. Wacker Drive, Chicago, Ill. 60606.

The central database can be optionally connected to a dedicated reporting server 140, using data mining and statistical reporting applications known in the industry such as Statistical Package for the Social Sciences (SPSS) applications provided by SPSS Inc., 233 S. Wacker Drive, Chicago, Ill. 60606.

The central database is typically connected to multiple cabinets in multiple geographical locations via controllers 10 (and multiplexers 40 when one controller 10 serves more than one cabinet 100). The controller 10 uses wired or wireless communication means to communicate with the central database, for example, by using GPRS to connect to a Web Server 110 over the Internet and then to a control server 120 that communicates with the database 130.

A cabinet 100 can contain RFID-tagged articles from multiple suppliers and manufacturers. Each supplier or manufacturer that is registered with the system of the invention via an enrolment station 150 can connect to the central database of the invention in order to manage its own RFID-enabled inventory. For example, a supplier or vendor of medical products can supply the medical products to multiple hospitals, each hospital having a multitude of RFID-enabled cabinets 100 according to the invention. The medical supplier is provided with means to query the central database and view the inventory level of each RFID-enabled article in each RFID-enabled cabinet 100 in each one of the hospitals. Naturally, each supplier or manufacturer registered with the system can only access information related to his own articles.

The enrolment station 150 can be either connected locally to the central database or, preferably, be connected remotely from each supplier or manufacturer. The remote connection may be either a dedicated, private connection or any public network means such as the Internet. The communication between the enrolment station 150 and the central database can use any security means available in the industry such as identification via user name and password and encrypted communication means.

A registered vendor, supplier or manufacturer of RFID-tagged articles stored in the cabinets also has access to the central database in order to update the central database with new information regarding its RFID-tagged articles. For example, when new RFID-tagged articles are introduced to the system, the database 130 must be updated with the articles' characteristics and inventory-level requirements. When RFID-tagged articles are no longer used and are retired from the system (and thus not be tracked anymore) the database 130 must be updated accordingly. The database 130 is also updated with any change or update to the inventory level requirement of an RFID-tagged article.

Figure 3:
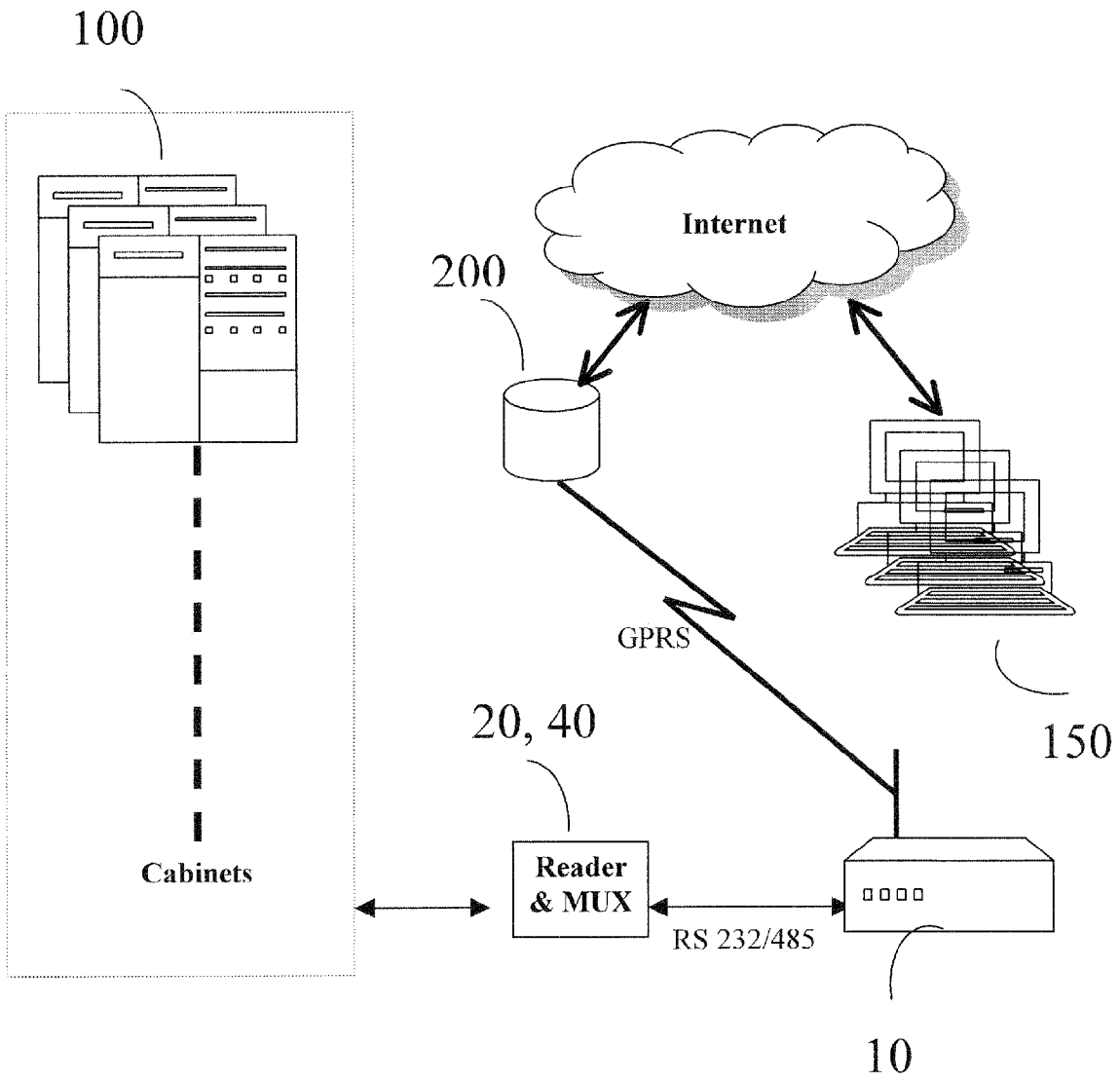
FIG. 3 illustrates a system according to the invention for managing inventory of RFID-tagged articles from a plurality of cabinets.

FIG. 3 illustrates an inventory management system for managing a plurality of RFID-enable cabinets 100 of the invention. The central database 200 is connected on one end to a plurality of enrolment stations 150, for example, via the Internet, and on the other hand the central database 200 is connected to one or more controllers 10, for example, via wireless GPRS means. In FIG. 3 the controller 10 is connected to a single unit that combines an RFID reader 20 and a multiplexer 40. The unit is then connected to a plurality of RFID-enabled cabinets 100. Each multiplexer 40 can be connected to a predetermined number of cabinets 100. Alternatively, each controller 10 can be connected to an RFID reader 20 connected to one or more multiplexers 40. Each multiplexer 40 then in turn, is connected to a plurality of RFID-enabled cabinets 100.

Figure 4:
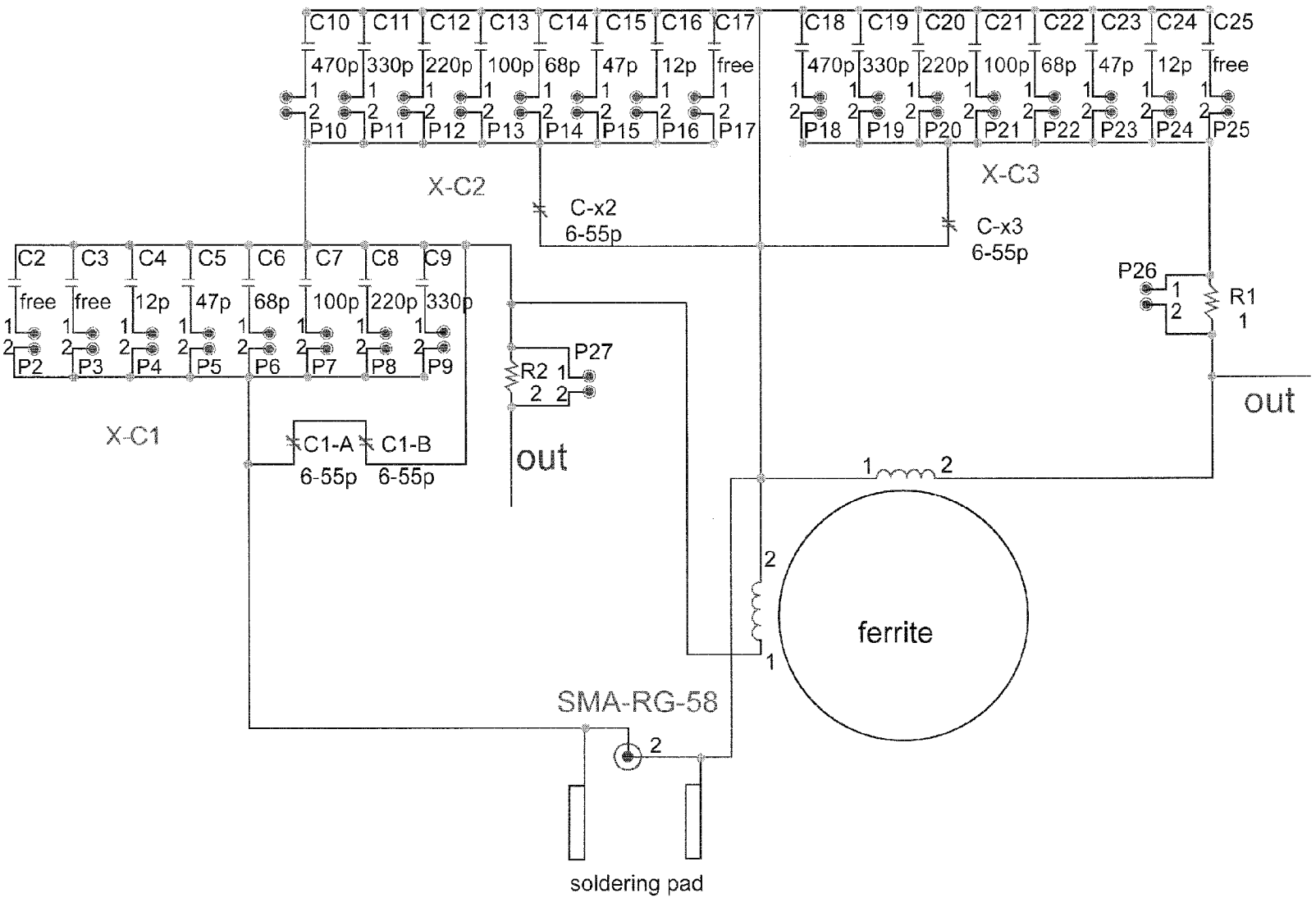
FIG. 4 shows an electrical circuit of a modular adaptation circuit for High Frequency (HF) antennae according to the invention.
Figure 5:
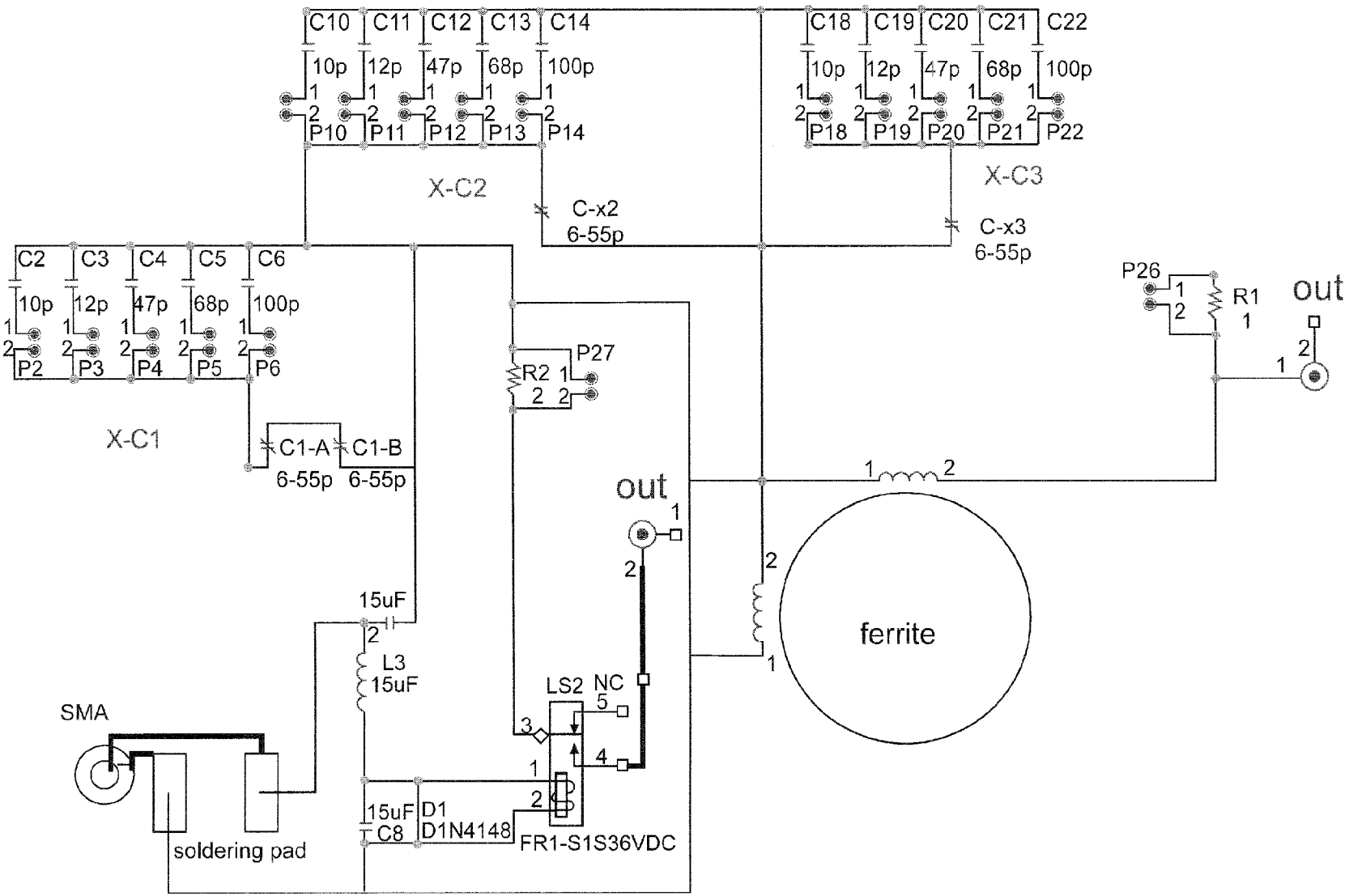
FIG. 5 shows an electrical circuit of a modular adaptation circuit for HF antennae according to the invention wherein each antenna is only activated when it is addressed.
Figure 6:
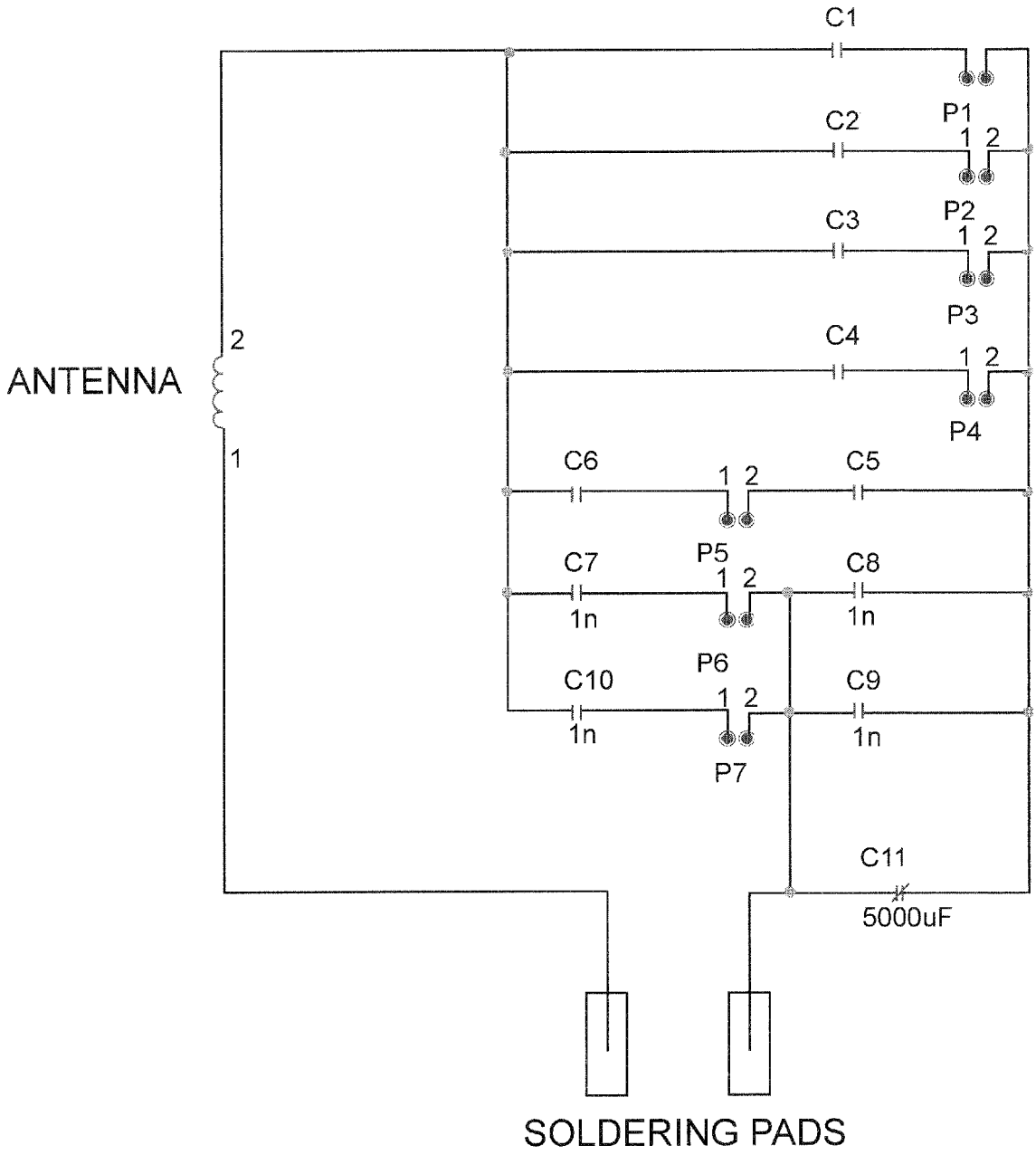
FIG. 6 shows an electrical circuit of a modular adaptation circuit for Low Frequency (LF) antennae according to the invention.

FIG. 4 shows an electrical circuit of a modular adaptation circuit for High Frequency antennae. FIG. 5 shows a modular adaptation circuit for HF antennae according to the invention wherein each antenna is only activated when it is addressed. FIG. 6 shows a modular adaptation circuit for Low Frequency antennae.

Figure 7:
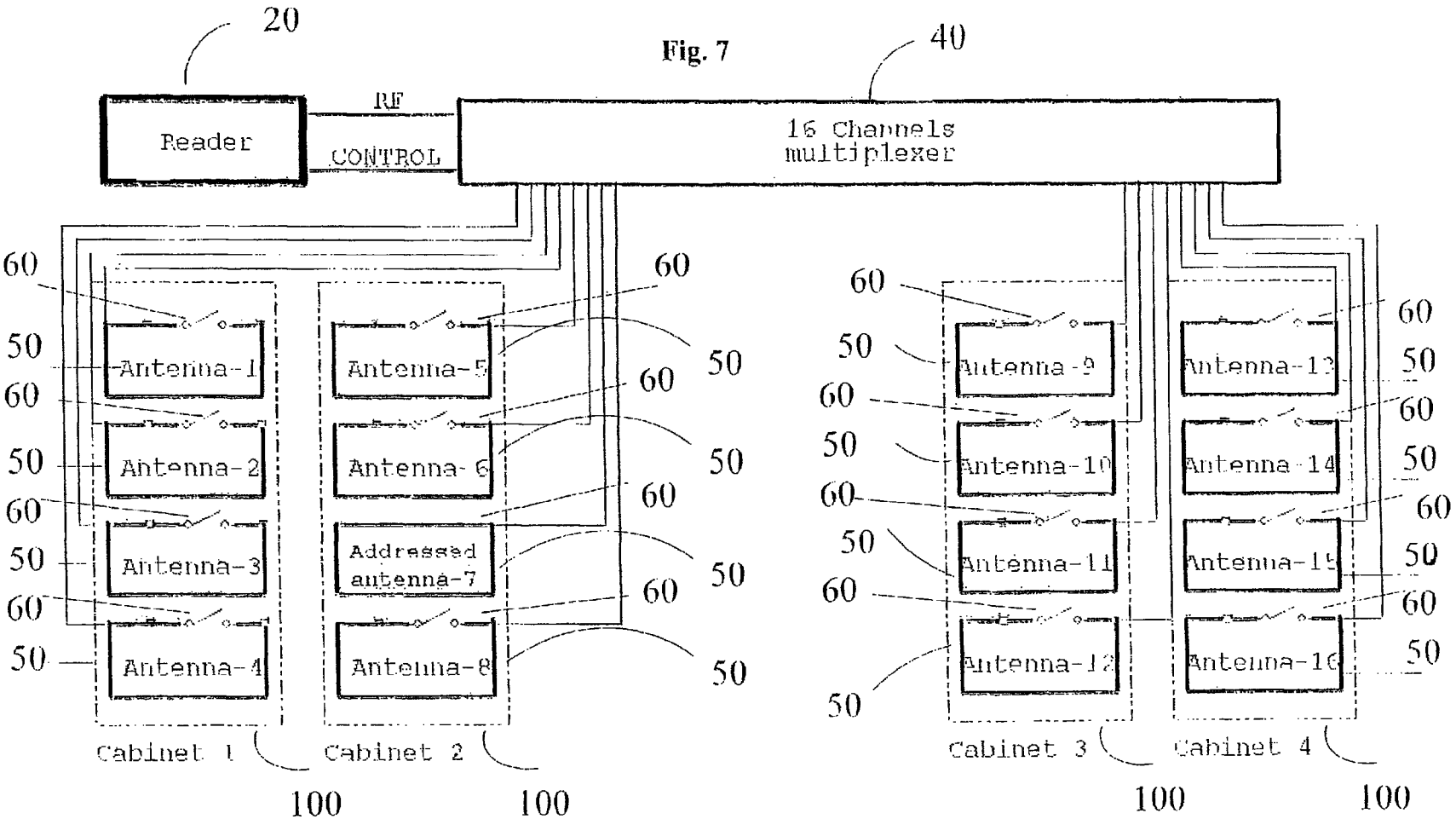
FIG. 7 shows an embodiment of a system according to the invention comprising a field of antennae wherein only a single antenna is activated.

FIG. 7 shows an embodiment of the invention comprising four RFID-enabled cabinets 100, each comprising four RFID antennae 50 of the invention. The four RFID-enabled cabinets 100 are all connected to a 16-channels multiplexer 40, in turn connected to an RFID reader 20. The connection between the multiplexer 40 and the RFID reader 20 exchanges both Radio Frequency (RF) and control information. All 16 RFID antennae 50 are directly addressable by the multiplexer 40. A switch 60 in each antenna 50 enables to activate or deactivate each antenna 50 individually. As shown in FIG. 7, all the RFID antenna 50 are deactivated except for antenna 50 number 7 where the switch 60 is ON thus closing the electrical circuit and activating the antenna 50.

One of the main objectives of the RFID-enabled inventory management is to continuously monitor the inventory level of each RFID-tagged article in each RFID-enabled cabinet 100, and issue an alert if a certain predefined condition is met. Examples of such predefined conditions that are tracked by the invention include, but are not limited to: (i) inventory level of an article has reached or is below a given value; (ii) inventory levels of a given article are above a given value; (iii) the expiration date of an article is within a given time period; and (iv) the expiration date of an article has been reached.

The alerts can be managed locally at the RFID-enable cabinet 100 level, or transmitted to a location such as the central database 200 for further processing.

The central database 200 can also generate: (i) usage reports and statistics about inventory levels at given time periods and other usage statistics for each article and/or location; (ii) alerts according to defined business rules; (iii) alerts in case of system malfunctions; and (iv) triggers on organization's Enterprise Resource Planning (ERP) according to business rules.

Although the invention has been described in detail, nevertheless changes and modifications, which do not depart from the teachings of the present invention, will be evident to those skilled in the art. Such changes and modifications are deemed to come within the purview of the present invention and the appended claims.

The invention claimed is:

1. A method for transforming a cabinet for storing RFID-tagged articles to an RFID-enabled cabinet, the method comprising the steps of:

(i) installing one or more RFID readers;

(ii) installing a controller;

(iii) adding communication means to said cabinet;

(iv) installing one or more antennae adapted to reading RFID tags of said RFID-tagged articles such that said one or more antennae cover the entire storage area of said RFID-enabled cabinet, and each antenna of said one or more antennae comprises a switch and a tuning board, the switch adapted to activating or deactivating the antenna, wherein said one or more antennae are initially detuned;

(v) activating each antenna of said one or more antennae periodically;

(vi) tuning the activated antenna;

(vii) reading nearby RFID tags; and (viii) detuning said tuned antennae.

2. The method according to claim 1, wherein said RFID-enabled cabinet communicates with a central database system.

3. The method according to claim 1, wherein said RFID-enabled cabinet issues an alert when a predefined condition is met.

4. The method according to claim 3, wherein said predefined condition comprises: (i) inventory level of an article has reached or is below a given value; (ii) inventory levels of a given article are above a given value; (iii) the expiration date of an article is within a given time period; and (iv) the expiration date of an article has been reached.

5. The method according to claim 1, wherein said communications means are wireless communication means.

6. The method according to claim 1, wherein said RFID-enabled cabinet contains RFID-tagged articles from multiple suppliers.

7. A kit for transforming a cabinet to an RFID-enabled cabinet adapted for storing RFID-tagged articles, the kit comprising:

(i) a controller comprising communication means;

(ii) one or more RFID readers connected to said controller;

(iii) one or more antennae adapted to reading RFID tags of said RFID-tagged articles such that said one or more antennae cover the entire storage area of said RFID-enabled cabinet, and each antenna of said one or more antennae comprises a switch and a tuning board, the switch adapted to activating or deactivating the antenna, wherein all the antenna are initially detuned and each antenna is periodically activated, tuned, made to read nearby RFID tags, and then detuned again; and (iv) at least one multiplexer connected to said one or more RFID readers and to said one or more antennae such that the at least one multiplexer can communicate, activate and deactivate each antenna individually.

8. The kit according to claim 7, wherein said communications means are wireless communication means.

9. The kit according to claim 7, wherein said RFID-enabled cabinet communicates with a central database system.

10. The kit according to claim 9, wherein said RFID-enabled cabinet issues an alert when a predefined condition is met.

11. The kit according to claim 10, wherein said predefined condition comprises: (i) inventory level of an article has reached or is below a given value; (ii) inventory levels of a given article are above a given value; (iii) the expiration date of an article is within a given time period; and (iv) the expiration date of an article has been reached.

12. The kit according to claim 7, wherein said RFID-enabled cabinet contains RFID-tagged articles from multiple suppliers.

13. A system for managing inventory of RFID-tagged articles from a plurality of vendors, said inventory being distributed across one or more geographical locations wherein each geographical location comprises one or more RFID-enabled cabinets, the system comprising:

a central database system;

(ii) a plurality of RFID-enabled cabinets for storing said RFID-tagged articles, said plurality of RFID-enabled cabinets being connected to the central database, wherein each RFID-enabled cabinet comprises: (a) a controller; (b) one or more RFID readers connected to said controller; (c) one or more antennae adapted to reading RFID tags of said RFID-tagged articles such that said one or more antennae cover the entire storage area of the cabinet, and each antenna of said one or more antennae comprises a switch and a tuning board, the switch adapted to activating or deactivating the antenna, wherein all the antennae are initially detuned and each antenna is periodically activated, tuned, made to read nearby RFID tags, and then detuned again; and (d) at least one multiplexer connected to said one or more RFID readers and to said one or more antennae such that the at least one multiplexer can communicate, activate and deactivate each antenna individually.

14. The system according to claim 13, wherein at least one RFID-enabled cabinet of said plurality of RFID-enabled cabinets communicates with the central database system using wireless communication means.

15. The system according to claim 13, wherein said cabinet issues an alert when a predefined condition is met.

16. The system according to claim 15, wherein said predefined condition includes: inventory level of an article has reached or is below a given value; inventory levels of a given article are above a given value; the expiration date of an article is within a given time period; and the expiration date of an article has been reached.

17. A field of RFID antennae adapted to read RFID tags of RFID-tagged articles, said field comprising a plurality of nearby RFID antennae, each RFID antenna comprising a switch and a tuning board, the switch adapted to activating or deactivating said RFID antenna, wherein all the antennae are initially detuned and each antenna is periodically activated, tuned, made to read nearby RFID tags, and then detuned again.

* * * * *